US005485928A

United States Patent [19]

Felton

[11] Patent Number: 5,485,928

[45] Date of Patent: Jan. 23, 1996

[54] MERCHANDISE DISPLAY RACK

[75] Inventor: J. Reed Felton, Milwaukee, Wis.

[73] Assignee: T. J. Hale Company, Menomonee Falls, Wis.

[21] Appl. No.: 159,520

[22] Filed: Dec. 1, 1993

[51] Int. Cl.[6] ..... A47F 5/00

[52] U.S. Cl. ..... 211/52; 211/59.3; 211/128; 312/61

[58] Field of Search ..... 211/52, 51, 59.3, 211/55, 128; 312/50, 61, 190

[56] References Cited

U.S. PATENT DOCUMENTS

| | | | |
|---|---|---|---|
| 181,834 | 9/1876 | Goehring . | |
| 380,877 | 4/1888 | Fellows | 312/50 X |
| 666,359 | 1/1901 | Schroeder . | |
| 2,110,299 | 3/1938 | Hinkle | 211/59.3 |
| 2,111,496 | 3/1938 | Scriba . | |
| 2,233,601 | 3/1941 | Goodfellow | 312/50 |
| 2,652,154 | 9/1953 | Stevens | 211/49 |
| 2,781,151 | 2/1957 | Campbell, Jr. | 221/45 |
| 2,912,113 | 11/1959 | Durec | 211/51 |
| 2,934,212 | 4/1960 | Jacobson | 211/59.3 |
| 3,083,067 | 3/1963 | Vos et al. | 312/71 |
| 3,452,983 | 7/1969 | Cook et al. | 211/51 X |
| 3,780,873 | 12/1973 | Silva | 211/49 D |
| 4,706,821 | 11/1987 | Kohls et al. | 211/59.3 |
| 4,762,235 | 8/1988 | Howard et al. | 211/59.3 |
| 4,907,707 | 3/1990 | Crum | 211/59.3 |
| 4,925,038 | 5/1990 | Gajewski | 211/59.2 |
| 4,949,849 | 8/1990 | Hardy | 211/128 X |
| 5,111,942 | 5/1992 | Bernardin | 211/59.3 |
| 5,265,738 | 11/1993 | Yablans et al. | 211/59.3 |

*Primary Examiner*—Karen J. Chotkowski
*Attorney, Agent, or Firm*—Jansson & Shupe, Ltd.

[57] ABSTRACT

A merchandise display rack has compartments for displaying products. Each such compartment has a rear panel, a front panel and a follower with a first panel portion mounted for movement toward the front panel when a product is removed from the compartment. The first panel portion and the front panel substantially abut one another when the compartment is emptied of products and the first panel portion and the rear panel substantially abut one another when the compartment is filled with products. The follower is guided along the bottom panel by a guide member which extends from the follower into a slot in the bottom panel. Such guide member has a mechanism for modifying its width to compensate for slot/guide member wear. Vertically adjacent compartments are staggered so that substantially the entirety of at least the lower compartment is readily visible.

9 Claims, 5 Drawing Sheets

FIG. 4
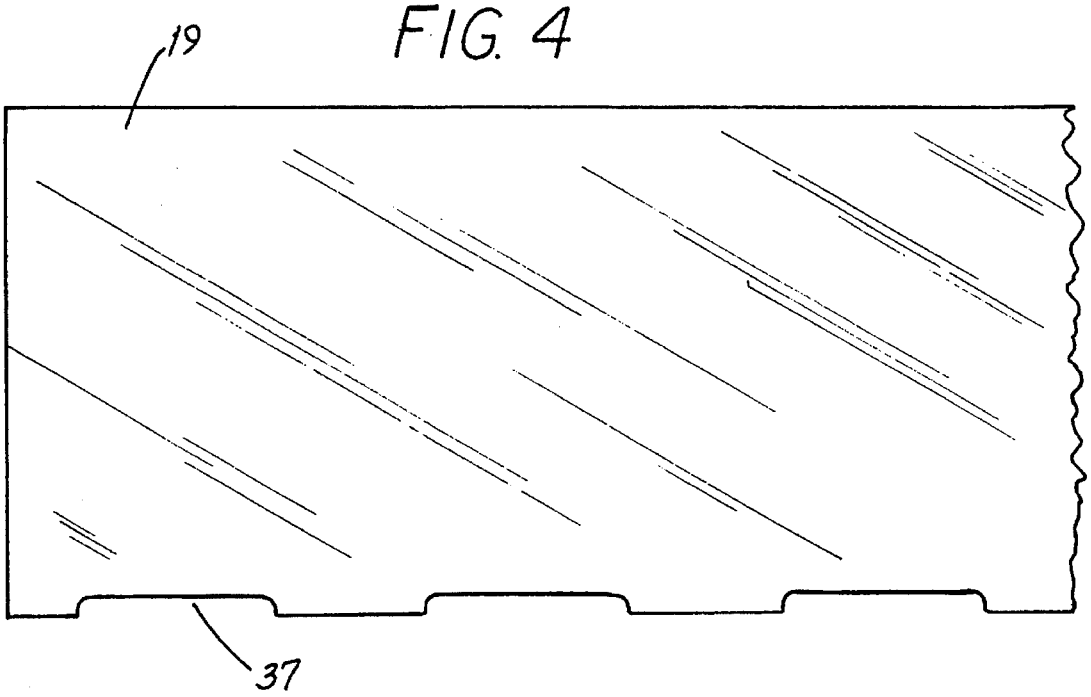
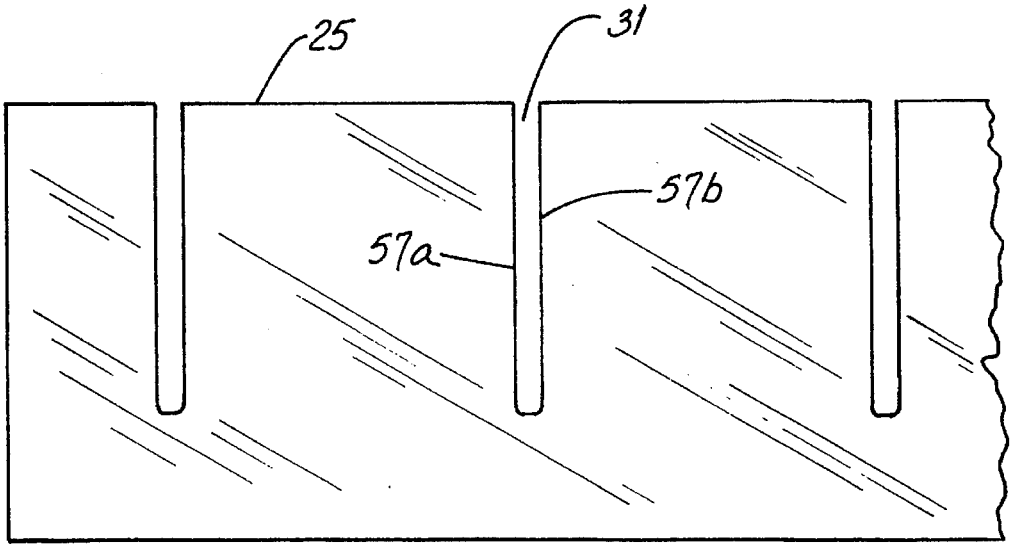
FIG. 5

MERCHANDISE DISPLAY RACK

FIELD OF THE INVENTION

The invention relates generally to supports involving racks and cabinet structures and, more particularly, to such a support for displaying products.

BACKGROUND OF THE INVENTION

Multi-tiered racks are widely used to display products being offered for sale by wholesalers, retailers and the like. Such racks are preferably arranged so that at least some of the products placed in or on them are readily visible for inspection and purchase. Examples of such racks are shown in U.S. Pat. Nos. 2,652,154 (Stevens); 4,762,235 (Howard et al.) and 5,111,942 (Bernardin). The store fixture system shown in the Howard et al. patent has several horizontal rows arranged in tiers for product display. Such tiers are arranged vertically one above the other.

It is advantageous to configure such racks so that at least some products on each of all tiers are visible at a glance to persons passing by. A way to do so is to arrange the rack so that each horizontal row juts slightly forward beyond the rows above it. The rack thereby has what might be described as a "terraced" appearance. Examples of terraced racks are shown in U.S. Pat. Nos. 3,083,067 (Vos et al.) and 4,706,821 (Kohls et al.).

The racks depicted in the aforementioned patents share a common feature in that all of them have plural product-holding compartments. Each such compartment has some sort of "pusher" device to help support the products upright for display purposes and to urge products forward to the compartment front whenever a product package is withdrawn from such compartment.

While such racks have been generally suitable for their intended purpose, they are characterized by certain disadvantages. One is that racks of the type shown in the Vos et al. and Kohls et al. patents are incapable of using the full depth of each compartment to hold merchandise for display. That is, a portion of the available compartment front-to-rear depth is occupied by a foot-like portion of the pusher device; the entire compartment depth cannot be filled with products.

Another disadvantage relates to the fact that such racks often involve what might be termed a guide component of the pusher device moving along a guide slot in the "floor" of the compartment. Such arrangement permits free fore-and-aft movement of the pusher device while at the same time restricting lateral device movement. The guide component and/or the guide slot are subject to wear due to device movement, whether because products are periodically loaded into the compartment by store personnel or are removed therefrom by purchasers. Either activity results in movement of the pusher device. Such prior art racks have no way to compensate for guide component/guide slot wear and thereby keep the pusher device generally centered in the compartment.

Yet another disadvantage of racks of the type shown in the Vos et al. and Kohls et al. patents is that even though such racks are somewhat terraced, the rear portions of all but the upper horizontal row of compartments are obscured from view by the compartment row immediately thereabove. As a consequence, store personnel are not easily able to see whether or not a particular compartment soon needs to be replenished with products.

A merchandise display rack which uses the full compartment depth to hold displayed merchandise, which includes a mechanism to compensate for wear and which is configured so that substantially the entirety of each compartment is readily visible would be an important advance in the art.

OBJECTS OF THE INVENTION

It is an object of the invention to provide an improved merchandise display rack overcoming some of the problems and shortcomings of the prior art.

Another object of the invention to provide an improved merchandise display rack having a compartment, the full depth of which is available to hold displayed merchandise.

Another object of the invention to provide an improved merchandise display rack which includes a mechanism to compensate for wear.

Yet another object of the invention to provide an improved multi-compartment merchandise display rack wherein substantially the entirety of the contents of each compartment is readily visible.

How these and other objects are accomplished will become apparent from the following descriptions and from the drawing.

SUMMARY OF THE INVENTION

The invention involves a display rack of the type having a compartment for displaying merchandise, e.g., hosiery, other dry goods, containerized products or the like. Such rack is configured with at least one compartment and, preferably, several such compartments so that products of differing size, color or the like can be displayed simultaneously.

In one arrangement, each compartment has a rear panel, a bottom panel, a front panel and a follower which moves fore-and-aft in the compartment and slides along the bottom panel. Stated otherwise, the generally-upright first panel portion of such follower is mounted for movement toward the compartment front panel when a product is removed from the compartment or toward the rear panel when a product is "loaded" into such compartment. Products are placed forward of the rear panel and, more specifically, between the follower and the front panel.

In one preferred rack arrangement, the front and rear compartment panels and the follower first panel portion are generally upright. Further, the front panel and the first panel portion are substantially planar and parallel to one another.

Products are held "sandwich-like" between the upright first panel portion of the follower and the compartment front panel. In one aspect of the invention, the first panel portion and the front panel substantially abut one another when the compartment is emptied of products. On the other hand, the first panel portion and the rear panel substantially abut one another when the compartment is filled with products. That is, the inventive rack is arranged so that the first panel portion can make an excursion of the full compartment depth.

More specifically, the follower (which is generally "L" shaped) has a second panel portion extending rearward from the first panel portion. Such second panel portion also extends rearward of the compartment rear panel when products are displayed in the compartment.

In a highly preferred embodiment, the rear panel and the bottom panel define a space between them. The second panel portion extends through the space and projects rearward beyond the rear panel when products are in the compartment. Further, the compartment has a first length and the second panel portion has a second length about equal to the first length.

In a highly preferred arrangement, the inventive display rack is configured so that, as to two compartments one above the other, substantially the entirety of the lower compartment is readily visible. For descriptive purposes, it is assumed that the rack front is coincident with a reference plane, e.g., a vertical plane extending through the rack front edge. The front panel of the upper compartment is spaced from the reference plane by a distance at least about equal to the distance between the reference plane and the rear panel of the lower compartment.

In that way, even the rearmost product in the lower compartment is readily visible just below or even forward of the front portion of the compartment immediately above it. And certain economies of manufacture (as well as good overall product visibility) arise when the front panel of the upper compartment is coplanar with the rear panel of the compartment immediately below.

Other details of the inventive rack involve a mechanism for compensating for wear of relatively-moving parts. A compartment bottom panel has a relatively narrow, elongate slot extending along substantially all of the panel depth and the follower (which is mounted for sliding movement along the bottom panel) has a guide member extending therefrom and into the slot. There is slight clearance between the slot and the guide member so that the follower can move freely while yet be constrained from significant lateral movement. The guide member includes a mechanism for modifying the width of the guide member to compensate for wear of such member and/or of the edges of the slot.

Such guide member is made of a somewhat resilient material, e.g., Delrin®, and has a pair of spaced-apart ribs. It also has a screw which is received through one rib and bears against the other. As the screw is advanced toward the other rib, the distance between ribs is modified, i.e., the ribs become slightly more spread apart.

The rack also includes a component which helps retain the follower atop the compartment bottom panel while yet permitting the follower to move freely with respect to such panel. To that end, at least one flange member extends laterally from the guide member for follower retention. When the rack is assembled, the bottom panel is interposed between the follower and the flange member and the follower and the flange member are spaced apart by a dimension somewhat greater than the thickness of such bottom panel. In that way, the follower can move freely along the bottom panel while yet being securely retained with respect to such panel.

Other details of the invention are set forth in the following detailed description and in the drawing.

BRIEF DESCRIPTION OF THE DRAWING

FIG. 4 is a front elevation view of a rear panel component of the rack of FIG. 1. Part is broken away.

FIG. 5 is a plan view of a bottom panel component of the rack of FIG. 1. Part is broken away.

DETAILED DESCRIPTION OF PREFERRED EMBODIMENT

Figure 1:
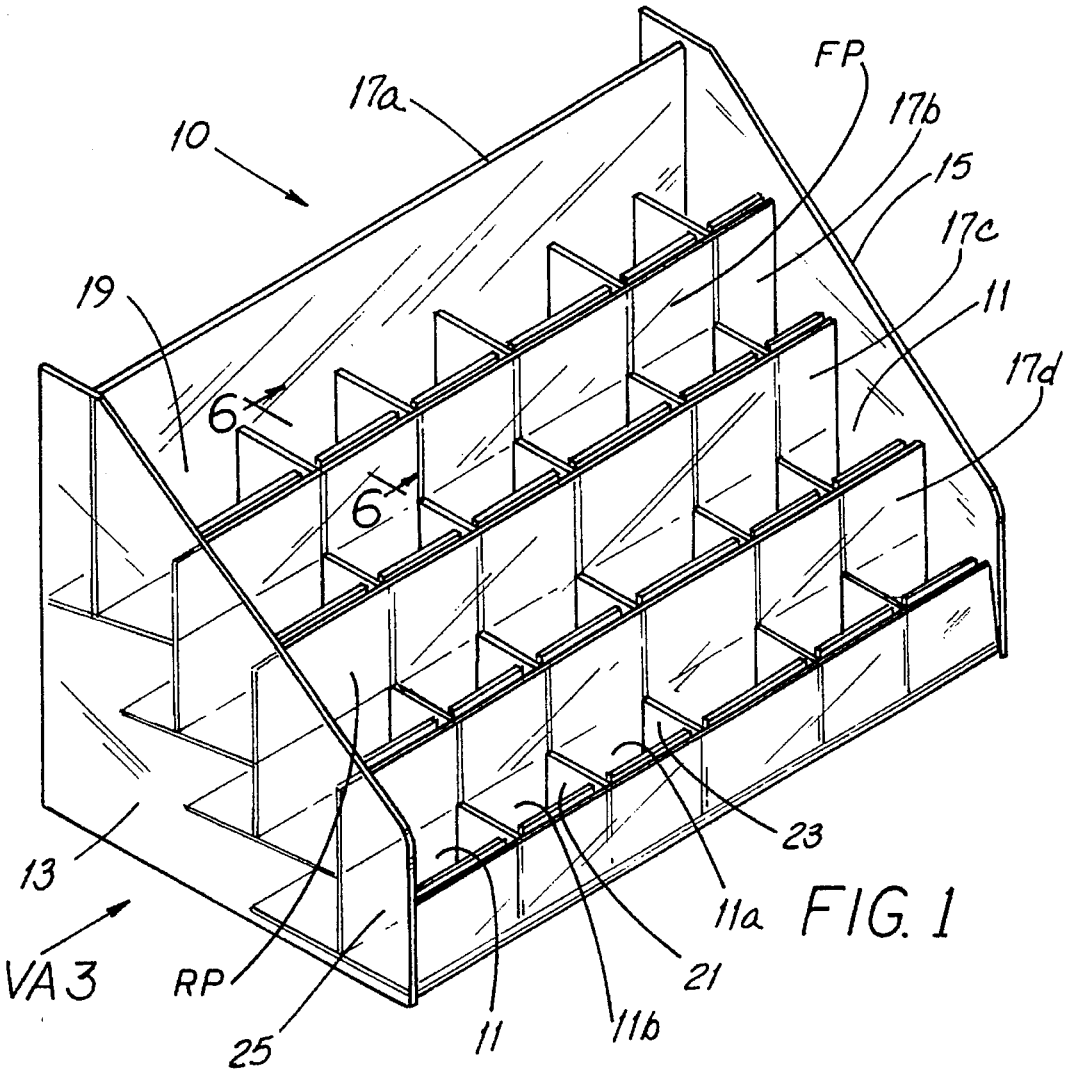
FIG. 1 is a perspective view of one embodiment of the new display rack.
Figure 2:
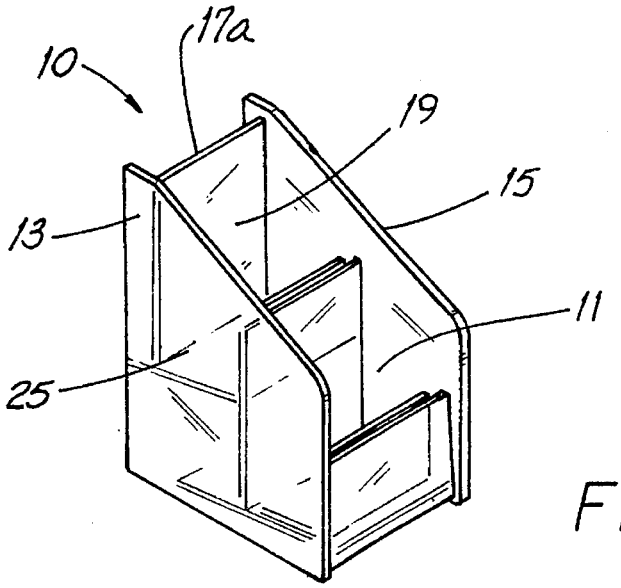
FIG. 2 is a perspective view of another, simpler embodiment of the new display rack.
Figure 3:
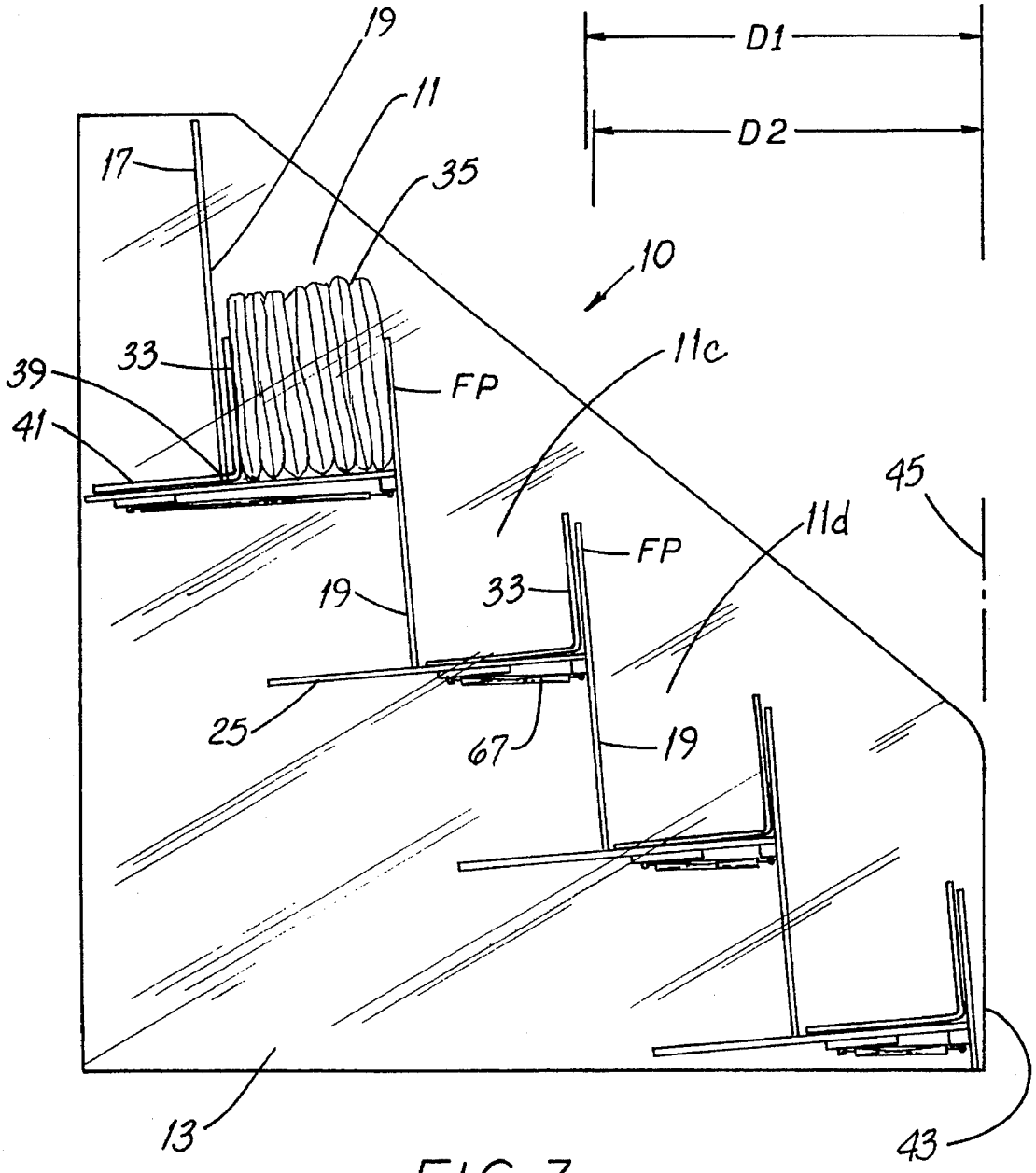
FIG. 3 is a side elevation view of the rack of FIG. 1 taken along the viewing axis VA3 thereof.

Referring first to FIGS. 1, 2 and 3, the invention involves a display rack 10 having a compartment 11 for displaying merchandise, e.g., hosiery, other dry goods, containerized products or the like. Preferably, such rack 10 is configured with at least two compartments 11 as shown in FIG. 2. A highly preferred rack 10 is shown in FIG. 1 and has several such compartments 11 so that products of differing size, color or the like can be displayed simultaneously.

The rack 10 has a pair of upright, substantially parallel laterally-spaced sides 13, 15 with a first or rear wall 17*a* extending between such sides 13, 15. As described in more detail below, each compartment 11 has a rear panel 19 and, advantageously, the rear wall 17*a* is common to all compartments 11 in the top row and forms a common rear panel 19 with respect to such compartments 11. An exemplary common rear panel 19 is shown in FIG. 4.

The rack 10 also has second, third and fourth walls 17*b*, 17*c*, and 17*d*, respectively, which similarly extend between the sides 13, 15. Each such wall 17*b*, 17*c*, 17*d* defines the front panel "FP" for compartments 11 to the rear thereof and the rear panel "RP" for compartments 11 to the front thereof. While this arrangement effects certain economies in material and manufacture, there is no reason from a functional standpoint why each compartment 11 could not have its own "dedicated" front and rear panels "FP" and "RP".

Each compartment 11 also has a first or left side panel 21 and a second or right side panel 23. In keeping with the economical use of materials and labor (and with some exceptions described below), the side panels 21, 23 do "double duty." That is, for compartments 11 spaced from the sides 13, 15, a left side panel 21 of one compartment 11, e.g., compartment 11*a*, is the right side panel of an adjacent compartment, e.g., compartment 11*b*. The exceptions, of course, involve the outer side panels of the compartments 11 at the extreme left and right of the rack 11. Such panels are defined by the sides 13, 15.

Each compartment 11 also has a bottom panel 25 which, a rear wall 17 described above, is preferably embodied as a panel common to all compartments 11 in a particular horizontal row. An exemplary common bottom panel 25 is shown in FIG. 5.

Referring additionally to FIGS. 6, 7, 8 and 9, each compartment 11 has a generally L-shaped follower 27 which moves fore-and-aft in the compartment 11 and slides along the bottom panel 25. Attached to the underside of the follower 27 is a bar-like guide 29 shaped like an inverted "T." As the follower 27 moves fore-and-aft, the guide 29 moves along an elongate slot 31 formed in the bottom panel 25. The guide 29 helps retain the first panel portion 33 of the follower 27 generally parallel to the front panel "FP" and the rear panel 19 "RP" of that compartment 11.

In FIG. 3, the compartment 11 is filled with products 35 which are held "sandwich-like" between the upright first panel portion 33 of the follower 27 and the compartment front panel "FP". The compartment 11*c* (as well as others depicted in FIG. 3) is empty of products 35.

It will be appreciated that as to compartment 11c of FIG. 3, the first panel portion 33 and the front panel "FP" substantially abut one another when the compartment 11*c* is emptied of products 35. On the other hand, the first panel portion 33 and the rear panel 19 substantially abut one another when the compartment 11 is filled with products 35. That is, the inventive rack 10 is arranged so that, unlike the racks depicted in the Kohls et al. and Vos et al. patents, the first panel portion 33 can make an excursion of the full compartment depth between the panels 19 and "FP".

Figure 6:
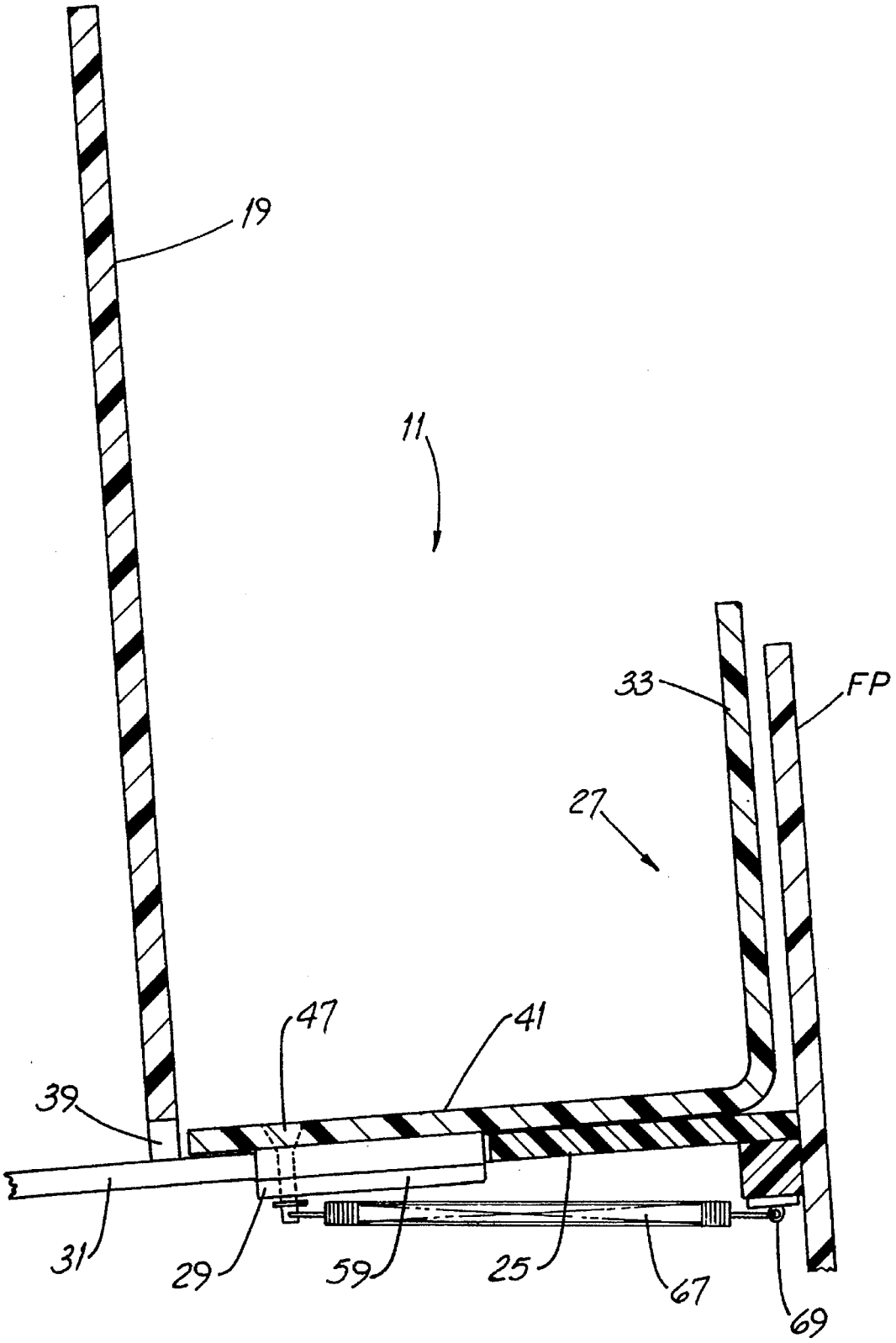
FIG. 6 is a sectional side elevation view of a single compartment taken generally along the viewing plane 6—6 of FIG. 1.

As shown in FIG. 4 and 6, each rear panel 19 has a cut-out area 37 so that when the rear panel 19 and bottom panel 25 are assembled to one another, they define a space 39 between them. The second panel portion 41 of the follower 27 extends rearward from the first panel portion 33 and, when products 35 are displayed in the compartment 11, also extends through the space 39 and rearward of the compartment rear panel 19. In a highly preferred arrangement, the front-to-rear length of the compartment 11 and the length of the second panel portion 41 are about equal to one another.

Referring to FIG. 3 and in another aspect of the invention, the display rack 10 is configured so that, as to two compartments one above the other, e.g., upper compartment 11*c* and lower compartment 11*d*, substantially the entirety of the lower compartment 11*d* and any products 35 therein is readily visible. For descriptive purposes, it is assumed that the rack front is coincident with a reference plane 45, e.g., a vertical plane extending through the rack front edge 43. The front panel "FP" of the upper compartment 11*c* is spaced from the reference plane 45 by a distance "D1" at least about equal to the distance "D2" between the reference plane 45 and the rear panel 19 of the lower compartment 11*d*.

In that way, even a product 35 at the rearmost portion of the lower compartment 11*d* is readily visible just below or even forward of the front portion of the compartment 11*c* immediately above it. And certain economies of manufacture (as well as good overall product visibility) arise when the front panel "FP" of the upper compartment 11*c* is coplanar with the rear panel 19 of the compartment 11*d* immediately below.

Other details of the inventive rack 10 involve the guide 29 which has a mechanism for compensating for wear of relatively-moving parts. Before setting out details of such mechanism, general features of the guide 29 will be described.

Referring to FIGS. 5 through 9, the guide 29 is made of a somewhat resilient plastic material, e.g., Delrin® plastic, and is secured to the underside of the follower 27 (and, more specifically, to the underside of the second panel portion 41) by one or two fasteners 47 which do not contact the slot 31 but, rather, secure the guide 29 and follower 27 to one another. The guide 29 has a guide member 49 with a pair of spaced ribs 51*a*, 51*b* defining a groove 53 between them. The dimension between the outer surfaces 55*a*, 55*b* of the ribs 51*a*, 51*b* is slightly less than the dimension between the edges 57*a*, 57*b* of the slot 31 so that there is slight clearance between the member 49 and the slot 31.

When the slot 31 and guide member 49 are so arranged and when the follower 27 moves forward and backward, the guide 29 keeps the follower 27 substantially centered laterally in the compartment 11. Such guide 29 also helps prevent the follower 27 from becoming "cocked" as it would be if turned about an axis perpendicular to the bottom panel 25 and to the follower second panel portion 41.

Figure 7:
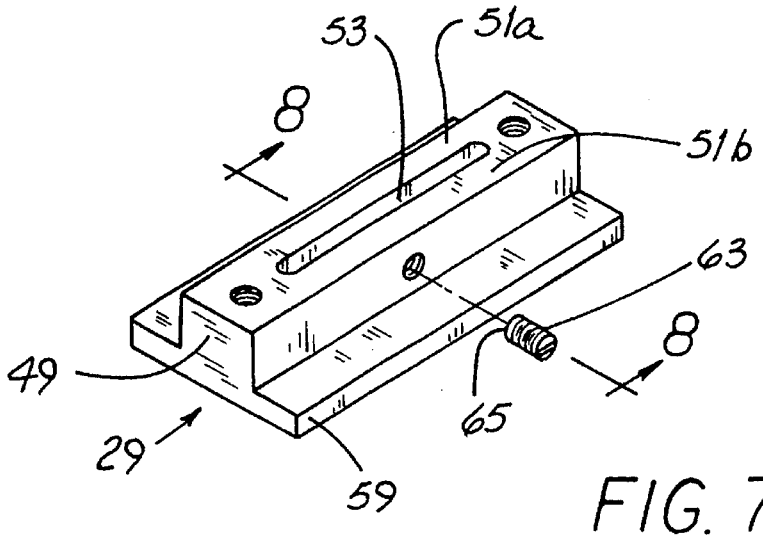
FIG. 7 is a perspective view of a follower guide used in the rack of FIG. 1.
Figure 8:
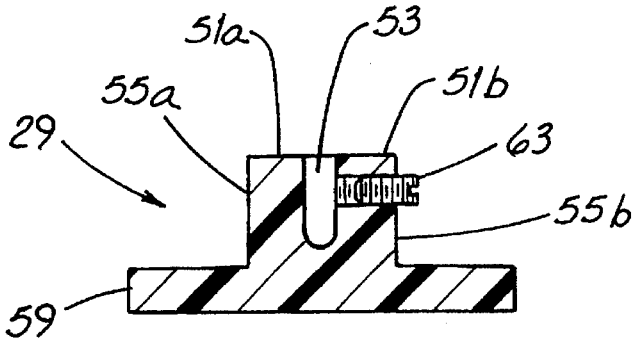
FIG. 8 is a sectional elevation view of the guide of FIG. 7 taken along the viewing plane 8—8 thereof.
Figure 9:
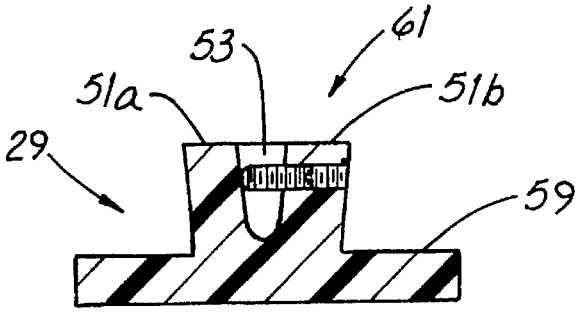
FIG. 9 is a sectional elevation view generally like that of FIG. 8 and showing operation of the wear-compensating mechanism.

Referring particularly to FIGS. 7–9, the rack 10 also includes a component which helps retain the follower 27 atop the compartment bottom panel 25 while yet permitting the follower 27 to move freely with respect to such panel 25. To that end, at least one flange member 59 extends laterally from the guide member 49 for follower retention. Preferably, the guide 29 has a pair of flange members 59, one extending laterally to either side of the guide 29.

As best seen in FIG. 6, the bottom panel 25 is interposed between the follower and the flange members 59. The follower 27 and the flange members 59 are spaced apart by a dimension somewhat greater than the thickness of such bottom panel 25. In that way, the follower 27 can move freely along the bottom panel 25 while yet being securely retained with respect to such panel 25.

Considering FIGS. 7–9, the guide wear compensating mechanism 61 will now be described. From the foregoing, it will be appreciated that as the follower 27 moves forward and rearward, the guide member 49 contacts one or the other of the edges 57 of the slot 31 from time to time. In fact, for any particular excursion of the follower 27, it is highly likely that such contact would occur and as it does, the guide member 49 and/or the slot edges 57 wear. Over time, the guiding "fit" between the member 49 and the slot 31 will become "sloppy" and the follower 27 will acquire more of a tendency to cock.

The mechanism 61 is configured for modifying the width of the guide member 49 to compensate for wear of such member 49 and/or of the edges 57 of the slot 31. To that end, a screw 63 is received through one rib 51*b* and when the rack 10 is new, such screw 63 is positioned so that its inward end 65 is spaced slightly from the rib 51*a*. As significant wear occurs, the screw 63 is advanced inward (right-to-left in FIGS. 8 and 9) until it bears against the rib 51*a*.

Further screw advance modifies the distance between ribs 51*a*, 51*b* in that they become slightly more spread apart. Such slight "bulging" of ribs 51*a*, 51*b* is apparent of a comparison of FIGS. 8 and 9, the latter showing bulging ribs 51. By proper screw adjustment, the dimension between the outer surfaces 55*a*, 55*b* of the ribs 51*a*, 51*b* can be restored to that prevailing when the rack 10 was new. If the slot edges 57 are worn (as is likely), such screw adjustment restores the slot/rib clearance to that prevailing when the rack 10 was new.

Referring again to FIGS. 3 and 6, each follower 27 is biased to a forward position by a tension spring 67 extending between a fastener 47 and a stationary anchor point 69. When a compartment 11 is loaded with products 35, e.g., packaged hosiery or the like, the follower 27 is moved rearward against the urging of the spring 67. When a packaged product 35 is removed from anywhere in the compartment 11, the follower 27 advances forward to keep those products 35 remaining therein in a generally upright, easy-to-grasp and easy-to-see position. While the rack 10 can be made of any of a number of materials, a highly preferred rack 10 is made of acrylic, a good selection in view of its clarity, durability, initial cost and ease of manufacture.

Several other aspects of the new rack 10 deserve brief mention. One is that the follower 27 rides directly on the bottom panel 25. It has been found that each follower 27 moves smoothly upon its bottom panel 25 without the necessity of using glides, rollers or the like therebetween.

Another is that the preferred follower 27 is guided by a bar-like guide 29 as described above rather than by individual bolt-like guide pins or the like. This is an advantage for at least two reasons. The first is that the use of metal guide pins would tend to accelerate the rate at which the edges 57 of the slots 31 wear. Another is that such pins provide no way to adjust for wear as with the guide 29 used in the inventive rack.

Yet another aspect of the new rack 10 is that flange members 59 are used instead of bolt or pin heads to retain the follower 27 on the bottom panel 25. Like the guide members 49, the flange members 59 are preferably of plastic (e.g., Delrin® plastic) and, unlike bolt heads, tend to impose little wear on the bottom panel 25.

While the principles of the invention have been shown and described in connection with specific embodiments, it is to be understood clearly that such embodiments are exemplary and not limiting. For example, each compartment 11 in a rack 10 need not have the same width.

I claim:

1. A rack having a compartment for displaying products, the compartment having a rear panel, a front panel and a follower with a first panel portion mounted for movement toward the front panel when a product is removed from the compartment, the improvement wherein:

the rack includes a mechanism for moving the follower in the compartment;

the first panel portion and the front panel substantially abut one another when the compartment is emptied of products;

the first panel portion and the rear panel substantially abut one another when the compartment is filled with products;

when the compartment contains products, the first panel portion and the front panel support the products forward of the rear panel for display in a way that a product front surface may be easily observed when viewed from a location above the compartment; and the follower has a second portion extending through a space to a location rearwardly of the rear panel when products are displayed in the compartment.

2. The rack of claim 1 wherein:

the compartment has a bottom panel;

the rear panel and the bottom panel define a space therebetween; and the second panel portion extends rearwardly through the space when products are displayed in the compartment.

3. The rack of claim 2 wherein the bottom panel extends rearwardly of the rear panel.

4. The rack of claim 3 wherein:

the compartment has a first length; and the second panel portion has a second length about equal to the first length.

5. The rack of claim 2 wherein the second panel portion slides along the bottom panel when products are removed from the compartment.

6. A rack having a compartment for displaying products, the compartment having (a) a bottom panel with a slot therethrough, and (b) a follower mounted for movement atop the bottom panel, the improvement wherein the compartment includes:

a guide member extending from the follower into the slot and having a width; and wherein:

the slot is defined by a pair of opposed surfaces on the bottom panel;

the guide member is between the opposed surfaces for guiding contact therewith as the guide member moves along the slot; and the guide member has a pair of spaced-apart ribs and includes a screw for modifying the spacing between the ribs, thereby compensating for wear of the guide member.

7. The rack of claim 6 wherein the screw is received in one rib and bears against the other rib.

8. A rack having a compartment for displaying products, the compartment having (a) a bottom panel with a slot therethrough, and (b) a follower mounted for movement along the bottom panel, the improvement wherein the compartment includes:

a guide member extending from the follower into the slot and having a width and a pair of spaced-apart ribs; and the guide member includes a mechanism for modifying the width to compensate for wear, such mechanism including a screw for changing the spacing between the ribs.

9. The rack of claim 8 wherein the screw is received in one rib and bears against the other rib.

* * * * *